US008749139B2

(12) United States Patent
Neate et al.

(10) Patent No.: US 8,749,139 B2
(45) Date of Patent: Jun. 10, 2014

(54) MICROWAVE DRIVEN PLASMA LIGHT SOURCE

(75) Inventors: Andrew Simon Neate, Near Leighton Buzzard (GB); Barry Preston, Melton Mowbray (GB)

(73) Assignee: Ceravision Limited

( * ) Notice: Subject to any disclaimer, the term of this patent is extended or adjusted under 35 U.S.C. 154(b) by 0 days.

(21) Appl. No.: 13/807,320

(22) PCT Filed: Jul. 5, 2011

(86) PCT No.: PCT/GB2011/001015

§ 371 (c)(1), (2), (4) Date: Jan. 10, 2013

(87) PCT Pub. No.: WO2012/004557

PCT Pub. Date: Jan. 12, 2012

(65) Prior Publication Data

US 2013/0099663 A1 Apr. 25, 2013

(30) Foreign Application Priority Data

Jul. 5, 2010 (GB) ..... 1011303.3

(51) Int. Cl.

| | |
|---|---|
| ***H01J 7/46*** | (2006.01) |
| ***H01P 1/26*** | (2006.01) |
| ***H01J 25/50*** | (2006.01) |
| ***H05B 41/16*** | (2006.01) |
| ***H01J 17/16*** | (2012.01) |

(52) U.S. Cl.
USPC ..... 315/39; 333/81 B; 315/39.51; 315/248; 313/634

(58) Field of Classification Search
USPC ..... 315/39; 333/81 B
See application file for complete search history.

(56) References Cited

U.S. PATENT DOCUMENTS 7,348,732 B2 * 3/2008 Espiau et al. ..... 315/39

FOREIGN PATENT DOCUMENTS

| | | | |
|---|---|---|---|
| GB | WO2010055275 A1 * | 5/2010 | ..... H01J 65/04 |
| WO | 2008048968 | 4/2008 | |
| WO | 2009063205 | 5/2009 | |
| WO | 2010055275 | 5/2010 | |

* cited by examiner

*Primary Examiner* — Douglas W Owens
*Assistant Examiner* — Syed M Kaiser
(74) *Attorney, Agent, or Firm* — Jennifer Meredith; Meredith & Keyhani, PLLC

(57) ABSTRACT

A lucent crucible of a Lucent Waveguide Microwave Plasma Light Source (LWMPLS) comprising a Light Emitting Resonator (LER) in form of a crucible (1) of fused quartz which has a central void (2) having microwave excitable material (3) within it. In one example, the void is 4 mm in diameter and has a length (L) of 21 mm. The LWMPLS is operated at a power (P) of 280 W and thus with a plasma loading P/L of 133 w/cm and a wall loading of 106 w/cm2. The lamp is thus operated with a high efficiency—in terms of lumens per watt—while having a reasonable lifetime.

7 Claims, 1 Drawing Sheet

MICROWAVE DRIVEN PLASMA LIGHT SOURCE

This application is a national stage under 35 U.S.C. 371 of International Application No. PCT/GB2011/001015 filed Jul. 5, 2011 which claims priority to and the benefit of United Kingdom patent application number 1011303.3 filed Jul. 5, 2010.

The present invention relates to a plasma light source.

In European Patent No EP1307899, granted in our name there is claimed a light source comprising a waveguide configured to be connected to an energy source and for receiving electromagnetic energy, and a bulb coupled to the waveguide and containing a gas-fill that emits light when receiving the electromagnetic energy from the waveguide, characterised in that:

(a) the waveguide comprises a body consisting essentially of a dielectric material having a dielectric constant greater than 2, a loss tangent less than 0.01, and a DC breakdown threshold greater than 200 kilovolts/inch, 1 inch being 2.54 cm, (b) the wave guide is of a size and shape capable of supporting at least one electric field maximum within the wave guide body at at least one operating frequency within the range of 0.5 to 30 GHz, (c) a cavity depends from a first side of the waveguide, (d) the bulb is positioned in the cavity at a location where there is an electric field maximum during operation, the gas-fill forming a light emitting plasma when receiving microwave energy from the resonating waveguide body, and (e) a microwave feed positioned within the waveguide body is adapted to receive microwave energy from the energy source and is in intimate contact with the waveguide body.

In our European Patent No 2,188,829 there is described and claimed a light source to be powered by microwave energy, the source having:

a body having a sealed void therein, a microwave-enclosing Faraday cage surrounding the body, the body within the Faraday cage being a resonant waveguide, a fill in the void of material excitable by microwave energy to form a light emitting plasma therein, and an antenna arranged within the body for transmitting plasma-inducing, microwave energy to the fill, the antenna having:

a connection extending outside the body for coupling to a source of microwave energy;

wherein:

the body is a solid plasma crucible of material which is lucent for exit of light therefrom, and the Faraday cage is at least partially light transmitting for light exit from the plasma crucible, the arrangement being such that light from a plasma in the void can pass through the plasma crucible and radiate from it via the cage.

We refer to this as our Light Emitting Resonator or LER patent. Its main claim as immediately above is based, as regards its prior art portion, on the disclosure of our EP1307899, first above.

In our European Patent Application No 08875663.0, published under No WO 2010055275, there is described and claimed a light source comprising:

a lucent waveguide of solid dielectric material having:

an at least partially light transmitting Faraday cage surrounding the waveguide, the Faraday cage being adapted for light transmission radially, a bulb cavity within the waveguide and the Faraday cage and an antenna re-entrant within the waveguide and the Faraday cage and a bulb having a microwave excitable fill, the bulb being received in the bulb cavity.

We refer to this as our Clam Shell application, in that the lucent wave guide forms a clam shell around the bulb.

As used in our LER patent, our Clam Shell application and this specification:

"microwave" is not intended to refer to a precise frequency range. We use "microwave" to mean the three order of magnitude range from around 300 MHz to around 300 GHz;

"lucent" means that the material, of which an item described as lucent is comprised, is transparent or translucent;

"plasma crucible" means a closed body enclosing a plasma, the latter being in the void when the void's fill is excited by microwave energy from the antenna;

"Faraday cage" means an electrically conductive enclosure of electromagnetic radiation, which is at least substantially impermeable to electromagnetic waves at the operating, i.e. microwave, frequencies.

We have recently disclosed LER improvements in Patent Applications filed on Jun. 30, 2011, under Nigel Brooks references Nos 3133 and 3134. The improvements relate to the incorporation of a lucent tubes within a bore in the solid body, the tube being integral with the body and having the void formed in it. In order to put beyond doubt that the present improvement applies to the improvements of these two applications, we define as follows:

The LER patent, the Clam Shell Applications and the above LER improvement applications have in common that they are in respect of:

A microwave plasma light source having:

a Faraday cage:

delimiting a waveguide and being at least partially lucent, and normally at least partially transparent, for light emission from it, and normally having a non-lucent closure;

a body of solid-dielectric, lucent material embodying the waveguide within the Faraday cage;

a closed void in the waveguide containing microwave excitable material; and provision for introducing plasma exciting microwaves into the waveguide;

the arrangement being such that on introduction of microwaves of a determined frequency a plasma is established in the void and light is emitted via the Faraday cage.

In this specification, we refer to such a light source as a Lucent Waveguide Microwave Plasma Light Source or LWMPLS.

With the objective of improving our LWMPLS, we have determined that by comparison with conventional plasma lamps using electroded bulbs we can achieve higher wattage per unit length of plasma.

To set this in perspective, the light output and lives of conventional electroded plasma, i.e. HID (High Intensity Discharge), bulbs is very dependent on both the minimum and maximum wall temperature. The minimum wall temperature sets the vapour pressure of the additives, the higher the additive pressure generally the higher the light output. The maximum wall temperature sets a limit on the life of the bulb. Below 725° C. bulbs can have a long life; above 850° C. the life deteriorates rapidly.

The wall loading of a bulb is its input power divided by internal bulb surface area, usually expressed in Watts per $cm^2$. Wall loading is used as crude metric to encompass both temperatures. Many proposals have been made to minimise the difference between these two temperatures. For long life of electroded bulbs, greater than 15,000 hrs life, 20 Watts per $cm^2$ is regarded as an upper limit while 50 Watts per $cm^2$ bulb lives are reckoned to be less than 2,000 hrs.

The efficiency with which microwave energy is converted into light—in terms of lumens per watt—increases in our LWMPLSs with their operating wattage, all other things being equal. This results from maximum temperature in the plasma increasing and is linked to conductivity or skin depth of the plasma which decreases as the power per unit length is increased.

We have been surprised by how marked this effect is and accordingly, we now believe that we can specify improved LWMPLS and LER performance, in terms of them or at least their plasma voids being short for their operational power.

According to the invention there is provided a Lucent Waveguide Microwave Plasma Light Source having a void length L and a rated power P, wherein:

the plasma loading of the rated power divided by the void length, i.e. P/L, is at least 100 W per cm, the void length being the overall void length minus two radii of a central portion of the void.

We prefer to operate at 125 W per cm or higher and for higher powers at least 140 W per cm.

Measuring plasma loading in terms of the actual length of the plasma in the void, which may be able to be observed through the lucent waveguide, is awkward. We prefer to measure the overall length of the void and subtract its radius from each end on the basis that the plasma is strongest in the central parallel portion of a domed end void and does not extend to the extreme end of flatter ended voids. While, it is possible to measure the actual microwave power, or at least the power transferred to a magnetron powering a LWMPLS, we prefer to measure power in terms of the rated power of the light source, i.e. the overall power consumption of the light source.

In some of our LWMPLSs, the plasma void is directly in the lucent crucible, as in our LER, and in others the plasma void is in a lucent bulb within a lucent waveguide as in our Clamshell Application. This invention and the definition of our LWMPLSs is not restricted to these two arrangements. Other arrangements are the subject of certain of our pending and un-published patent applications.

Again in certain of our LWMPLSs, we are able to operate at much lower internal surface areas of their voids for their operational power.

In particular, we prefer to operate at a wall loading of between 100 W per $cm^2$ and 300 W per $cm^2$. For higher powers, we would normally expect to operate at least at 125 W per $cm^2$ and preferably in the range between 150 W per $cm^2$ and 250 W per $cm^2$.

We measure wall loading in terms of the internal surface area of the part of the void for which we measure plasma loading, with the power being the rated power.

We ascribe the fact that we can operate at such higher wall loading than traditionally to the conductive and radiant heat transfer occurring from our lucent crucibles and waveguides.

To help understanding of the invention, a specific embodiment thereof will now be described by way of example and with reference to the accompanying drawings, in which.

Figure 1:
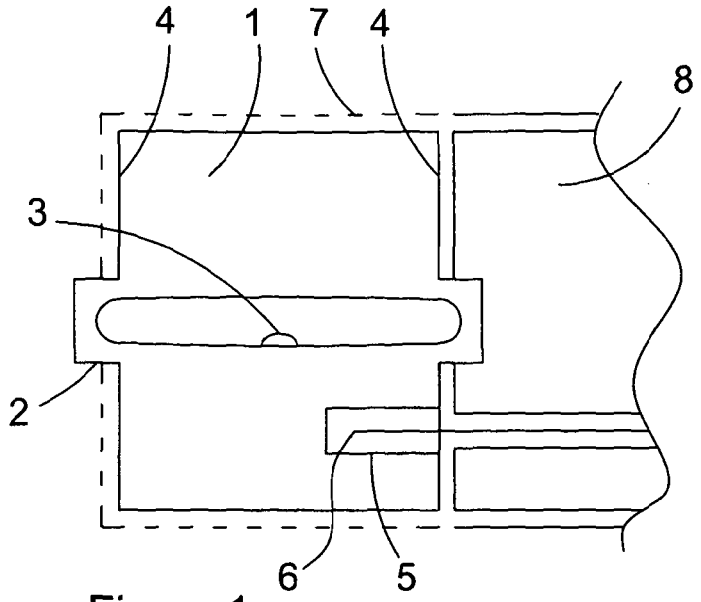
FIG. 1 is a side view of an LER in accordance with the invention.

Referring to the drawings, a lucent crucible 1 for an LER LWMPLS has a central void 2 having microwave excitable material 3 within it. The void is 4 mm in diameter and 21 mm long. The crucible is of fused quartz and is 21 mm long between end flats 4 and is circular cylindrical with a 49 mm outside diameter. The identicalness of the length of the void and the length between the end flats of the crucible results from this being constructed from a piece of quartz, having a bore and closed at the ends of the bore. The length of the crucible—but not the void—is somewhat arbitrary for present purposes, because in the preferred $TM_{010}$ mode, resonance is independent of the crucible length. This LER is designed to operate at 280 watts at 2.45 GHz.

Also shown are a bore 5 for an antenna 6 to introduce microwaves into the crucible and a Faraday cage 7 for retaining microwave resonance within the crucible. It is backed by an aluminium carrier 8 to which it is held by the cage.

With the LER operating at 280 Watts in $TM_{010}$ mode, corresponding to a plasma loading of 133 W per cm and a wall loading of 106 W per $cm^2$, we measure a wall temperature of 700° C. Such a device has an efficacy of up to 110 lumens per Watt.

Figure 2:
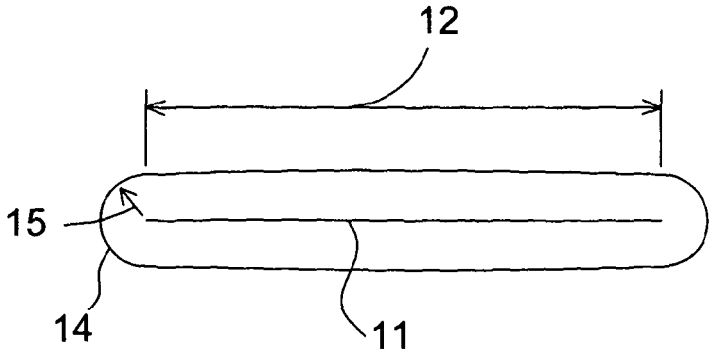
FIG. 2 is a larger scale scrap view of the void.

To measure the plasma loading, we divide the rated power of the LER by the length of the plasma. In our experience the plasma 11 stops just short of the full length 12 of the void, as shown in FIG. 2. The void generally has domed ends 14. We measure the overall length of the void and subtract its radius 15 from each end on the basis that the plasma is strongest in the central parallel portion of a domed end void and does not extend to the extreme ends of flatter ended voids.

In order to achieve efficacies>110 lumens per Watt we have found it necessary to increase the loading per unit length of plasma to be greater than 150 W per cm. In order that the lamp has a reasonable lifetime, simultaneously, we have found it necessary to restrict the maximum wall loading to be less than 300 W per $cm^2$ and preferably less than 250 W per $cm^2$.

Examples of higher plasma loadings for crucibles operating in the $TM_{010}$ mode are:

| | | |
|---|---|---|
| 1. | Void Length | 11 mm |
| | Void Diameter | 5 mm |
| | Power | 280 W |
| | Plasma Loading | 233 W per cm |
| | Wall Loading | 145 W per $cm^2$ |
| 2. | Void Length | 14 mm |
| | Void Diameter | 3 mm |
| | Power | 280 W |
| | Plasma Loading | 200 W per cm |
| | Wall Loading | 210 W per $cm^2$ |

Thus for high efficiency LERs with reasonably long life the operating conditions may be set out as follows:

| | |
|---|---|
| Arc or plasma loading | Power input per unit length of plasma >100 W per cm |
| Wall loading | 100 W per $cm^2$ < Plasma crucible wall loading <300 W per $cm^2$ |
| Preferred wall loading | 100 W per $cm^2$ < Plasma crucible wall loading <250 W per $cm^2$ |

While these conditions apply to resonators operating in any mode, cylindrical LERs operating in the TM010 and TM110 modes have advantages in ease of manufacturability and cost compared to resonators operating in other modes. This is because these two modes have the property that the resonant frequency is independent of the length of the cavity. This makes it particularly easy to vary the power input per unit length of plasma by varying the length of the LER and using butt sealed tubes at each end of the resonator the cost is kept to a minimum.

The invention claimed is:

1. A Lucent Waveguide Microwave Plasma Light Source (LWMPLS) comprising:

a magnetron of a power such that the light source has a rated power P and a body of solid-dielectric lucent material having a closed void length L, wherein:

a plasma loading of the rated power divided by the void length (P/L) is at least 100W per cm, a wall loading of rated power divided by internal surface area of the void is between 100 W per $cm^2$ and 300 W per $cm^2$, the void length being the overall void length minus two radii of a central portion of the void and the internal surface area of the part being measured between one radius of a central portion from each end of the void.

2. A LWMPLS as claimed in claim 1, wherein the plasma loading of the rated power divided by the void length is at least 125W per cm.

3. A LWMPLS as claimed in claim 1, wherein the plasma loading of the rated power divided by the void length is at least 140 W per cm.

4. A LWMPLS as claimed in claim 1, wherein the plasma void is directly in the lucent crucible.

5. A LWMPLS as claimed in claim 1, wherein the plasma void is in a lucent bulb within a lucent waveguide.

6. A LWMPLS as claimed in claim 1, wherein the wall loading of rated power divided by internal surface area of the void is between 125 W per $cm^2$ and 300 W per $cm^2$.

7. A LWMPLS as claimed in claim 6, wherein the wall loading of rated power divided by internal surface area of the void is between 150 W per $cm^2$ and 250 W per $cm^2$.

* * * * *